United States Patent [19]

Laflaquiere et al.

[11] 3,936,995

[45] Feb. 10, 1976

[54] TEXTILE MACHINE FRAMES

[75] Inventors: Regis Laflaquiere; Radovan Janousek, both of Mulhouse; Albert Wettel, Brunstatt, all of France

[73] Assignee: Societe Alsacienne de Constructions Mecaniques de Mulhouse, Mulhouse Cedex, France

[22] Filed: Nov. 8, 1973

[21] Appl. No.: 413,948

[30] Foreign Application Priority Data

Nov. 10, 1972 France ..... 72.39862

[52] U.S. Cl. ..... 57/1 R; 57/136

[51] Int. Cl.[2] ..... D01H 1/16

[58] Field of Search... 57/1 R, 34 R, 136, 58.89–58.95; 52/325, 738, 739

[56] References Cited

UNITED STATES PATENTS

| | | | |
|---|---|---|---|
| 2,923,119 | 2/1960 | Nifenecker | 57/1 R |
| 3,103,095 | 9/1963 | Keyser | 57/1 R |
| 3,410,074 | 11/1968 | Nimtz et al. | 57/136 X |
| 3,641,757 | 2/1972 | Rehn | 57/1 R X |
| 3,774,382 | 11/1973 | Bartling | 57/1 R |
| 3,782,087 | 1/1974 | Franzen et al. | 57/1 R |
| 3,782,095 | 1/1974 | Bures et al. | 57/1 R X |

*Primary Examiner*—John Petrakes

*Attorney, Agent, or Firm*—Holman & Stern

[57] ABSTRACT

A frame for a textile machine such as a spinning frame, a twisting machine or a rewinding machine, which includes a series of similar stations, said frame comprising a hollow rectilinear central girder having support elements, such as bosses, webs, notches, and bores, which are integral parts of the girder and are adapted to support, directly and with great accuracy, the parts of the various stations of the machine. The girder is preferably made up of a plurality of lengths fitted together end to end, preferably with end faces perfectly perpendicular to the general direction of the girder. The girder may be cast or extruded.

2 Claims, 5 Drawing Figures

TEXTILE MACHINE FRAMES

BACKGROUND OF THE INVENTION

The invention relates to textile machines such as spinning frames, twisting machines and rewinding machines, which includes a series of similar stations.

The development of the art, particularly as regards the constant increase in the speeds of rotation of the various parts as well as of the forces, torques and stresses involved, has led to these machines having to be more and more rigid, elements having to be positioned with increasing precision, and vibrations having to be damped down as much as possible.

PRIOR ART

Now, the technique hitherto in current use for manufacturing the frames of such machines does not lend itself to the obtaining of the desired results. Indeed, this technique consists in fitting together vertical frame members, often made up of two uprights connected by a cross-piece in such a way as to recall the general shape of the letter H, by means of horizontal stringers or longitudinal stiffening members on which are then mounted the various parts of the machine. Such a frame cannot have exemplary rigidity; the stringers which connect two successive frame members cannot be strictly in alignment with the preceding stringers, nor with the succeeding stringers, with the result that, for positioning of the parts, it is necessary to provide individual supports which are individually adjustable both vertically and horizontally in a transverse direction. There is no doubt that such supports appreciably increase the cost of the machine and the cost of setting the same up in a works, not to take into account the considerably extra work necessitated by its dismantling before delivery and the setting which has to be started over again in a user's premises. In short, such frames lack rigidity, they do not damp down vibrations well, with the inadequacy of precision in the positioning of the various parts being indeed a cause for increase in vibrations, their manufacturing cost is high, they complicate the structure of the whole of the complete machine, they require a tedious setting, their dismantling before delivery is also very complicated, and re-setting at a user's premises is no less long and onerous. All these disadvantages become increasingly significant as the machine increases in length, with the difficulties increasing much more quickly than the length of the machine.

OBJECT AND SUMMARY OF THE INVENTION

The object of the invention is to provide a machine frame which makes it possible to obviate or mitigate all the aforesaid disadvantages at one and the same time and which, moreover, has additional advantages.

According to the present invention, there is provided a frame for a textile machine such as a spinning frame, a twisting machine or a rewinding machine which includes a series of similar stations, said frame comprising a hollow rectilinear central girder having support elements, such as bosses, webs, notches, and bores, which are integral parts of the girder and are adapted to support, directly and with great accuracy, the parts of the various stations of the machine.

The product of the invention is a very rigid frame on which vibrations possibly originating are of only relatively smal amplitude and by which they are damped down to a considerable extent, since this girder makes up in whole or in part, a common support or a casing common to all the machine stations, in such a manner that the substantial and compact design of the whole is favorable to the damping down of the vibrations.

The positioning of the various parts of the working stations is immediate and automatically accurate, both in each station and in one station in relation to all the others. This concept of a central girder with a compact structure serving as a common support greatly facilitates the setting and the transport of the machines, while at the same time rendering the risk of distortions practically nil.

It is very easy, without adding any other parts, to make this central girder in such a way that it has one hollow or a plurality of hollows of a shape stretching or extending the full length of the machine and capable of being fully closed if desired. The or each hollow, whether open or closed, provides a sure and scarcely onerous means of arranging fluid-tight channels suitable for the circulation of a liquid or gaseous fluid, whether or not loaded with solid particles, such as, for example, air possibly carrying along textile fibers or different wastes.

In addition, the or each open or closed hollow likewise provides ready-made trunking for mechanical, pneumatic, electrical or other elements.

The guides may or may not be made up of different elements which may or may not be of equal length, according to the length of the machine to be constructed, and, in particular, the number of working stations to be brought into play and their inter-spacing.

In the case of machines of considerable length in which this central girder is in fact composed of aligned girder elements, the simple and precise fitting together of these different elements in a manner to have regard for their perfect alignment and/or positioning, is effected by tested mechanical methods. Mention may be made, by way of example, of bolting together by adjusted bolts, or else fitting together by dovetails or by cottering. The fitting together is preferably effected by end faces which are perfectly perpendicular to the general direction of the girder.

The term "central girder" used hereinafter and in the claims is to be construed as embracing either the central girder or successive elements of the central girder, with these elements each serving for supporting several working stations.

The central girder may or may not be of composite construction, and metallic materials, may or may not be used in its construction. It may, for example, be made from metal which may be cast or extruded.

The concept of the invention is of general advantage for the machines at issue, notably spinning frames, twisting machines or rewinding machines, may be applied, inter alia, particularly well to the construction of machines for spinning bast fibers.

The spinning elements of machines for spinning bast fibers are basically made up of a device for feeding fiber bands or tufts, a device for separating the fibers, which may or may not cause at the same time stretching or spreading of the fibers in order to free them from one another, a turning element which may or may not collect the fibers and is intended to impart twist to the thread, a device making it possible to ensure delivery of the thread by turning cylinders or other systems, and a device for reeling the thread and enabling it to be presented in the form of bobbins.

In almost all these cases, these elements are driven and positioned along the full length of such machines by longitudinal elements. Mention may be made, by way of nonlimiting example, of fixed or rotating shafts, belts, tubes, tablards, or else battens, all of which constitute such longitudinal elements.

The invention will be better understood by reading the description which follows and by examining the accompanying drawings which show by way of nonlimiting examples, some embodiments of frames for textile machines in accordance with the invention.

DETAILED DESCRIPTION OF THE INVENTION

Figure 1:
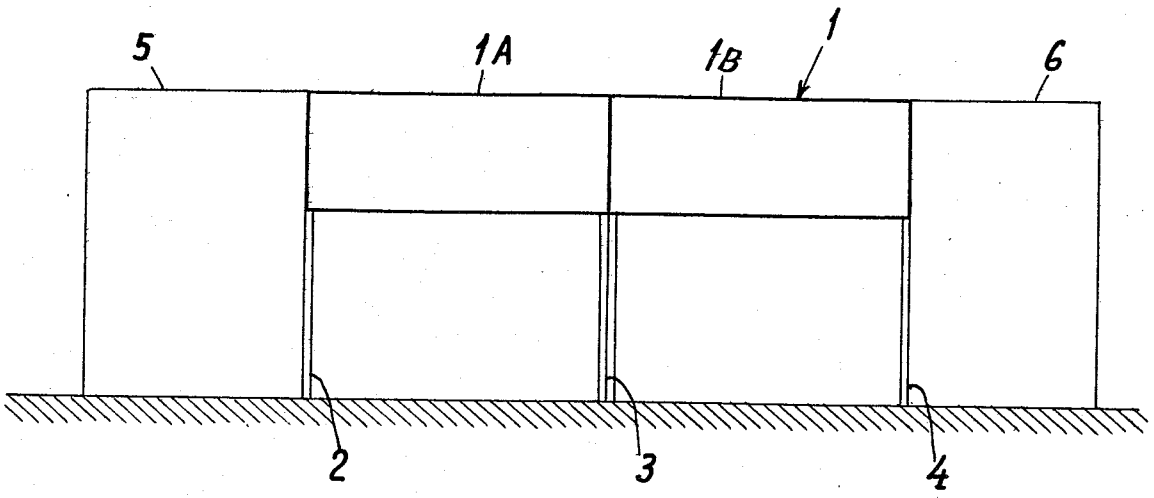
FIG. 1 is a diagrammatic elevation of a frame comprising a central girder in two parts.

The textile machine frame shown in FIG. 1 comprises basically a central hollow rectilinear girder generally designated by the reference numeral 1, mounted on legs 2,3,4, and bounded at its ends; for example, by end cupboards or casings 5,6 which contain, for example, driving mechanisms for the various parts of the machine and/or electrical control equipment for these parts and a drive motor for the machine. In this embodiment, the central rectilinear girder 1 is made up of two parts 1A and 1B of the same section fitted together, end to end, one to the other.

Figures 2, 3:
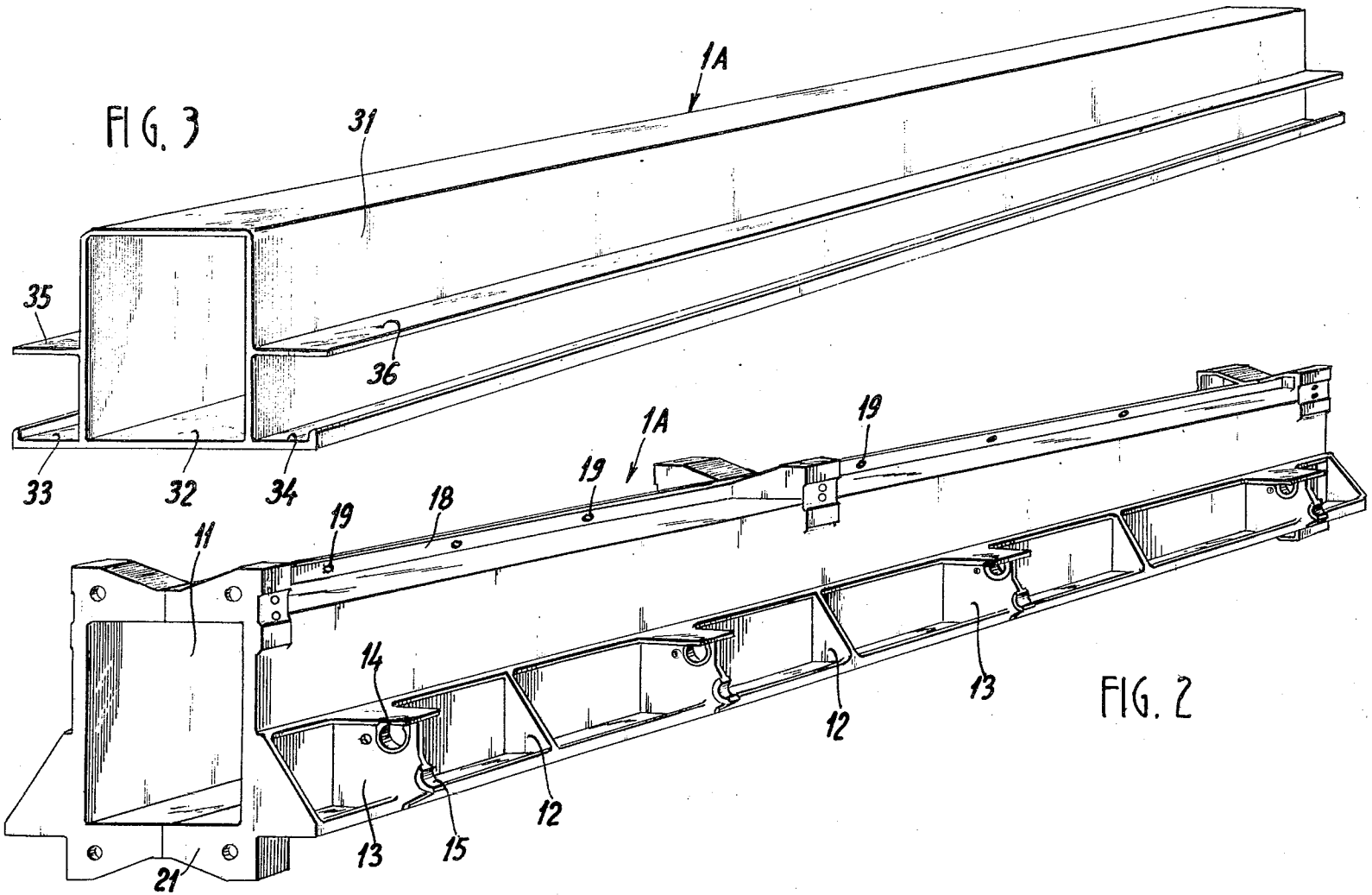
FIG. 2 is a perspective view showing in more detail one of the two parts of the girder of the frame of FIG. 1.
FIG. 3 is a perspective view of a modification of the girder part of FIG. 2.

In FIG. 2 there can be seen in more detail one example of how one of the two parts of the central girder 1, namely the part 1A, may be constructed. It is tubular in form and provides a longitudinal conduit 11. Its lateral faces have reinforcing webs, such as 12, and other webs, such as 13, which serve as supports of co-axial bearings 14,15 intended to receive shafts which extend the whole length of the frame. One face 18, which extends the whole length of the girder, has holes 19 for precise positioning of and fixing in place parts of various stations which this girder has to support.

The two end faces of the girder part 1A, (the face 21 is seen in FIG. 2), are perfectly trued and perpendicular to the longitudinal direction of the girder in order to serve as bearing surfaces for fitting another frame part, for example a girder part similar to the part 1A, or else and end casing, such as the casing 5 for example (FIG. 1).

While the girder part 1A shown in FIG. 2 is of cast metal, there is shown in FIG. 3, by way of modification, a girder part 1A which is extruded. Its main part 31 if of rectangular section and it has two lateral wings 33,34 in planar extension of its lower wall 32, and two other wings 35, 36 at an intermediate level, with all four wings extending the full length of the girder.

Figure 4:
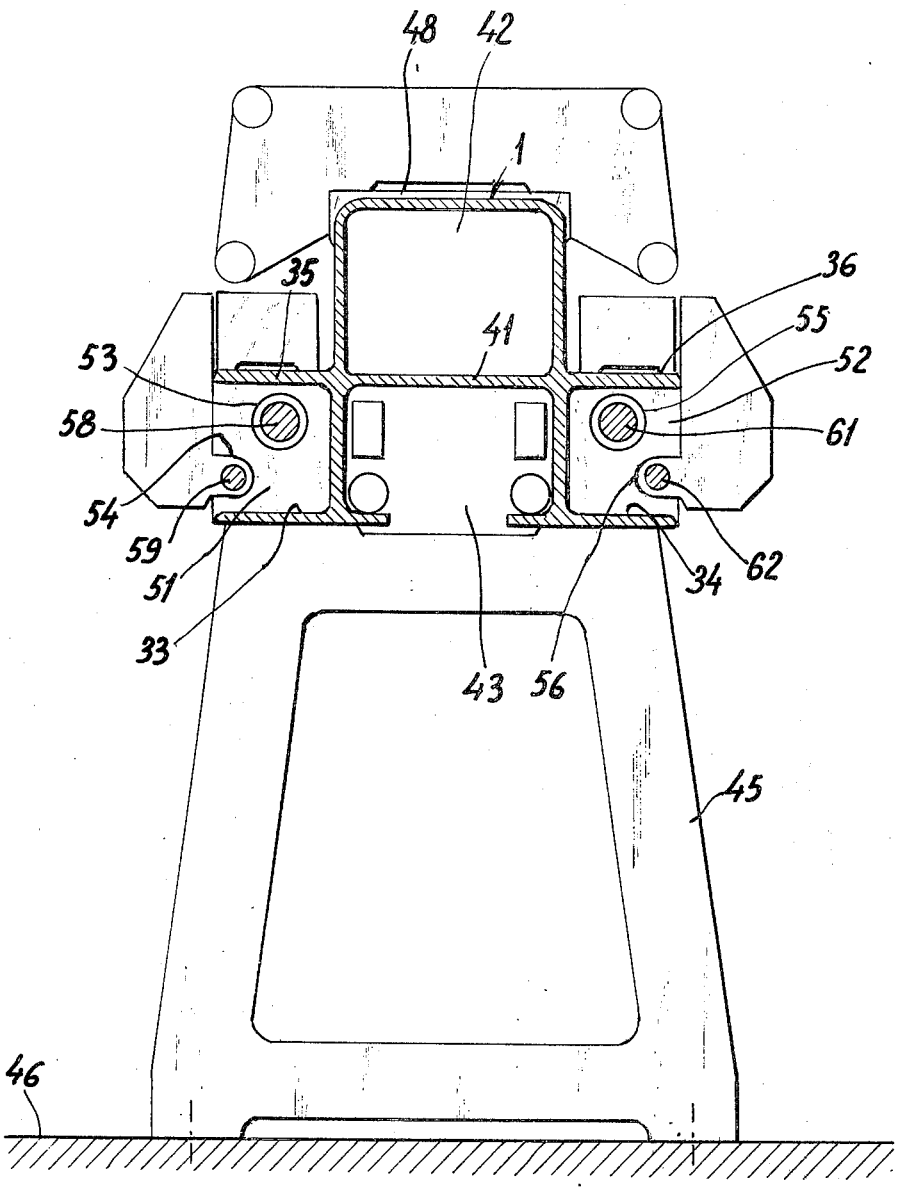
FIG. 4 is a section through a frame of a machine for spinning bast fibers comprising a central girder similar to that of FIG. 3.

The central girder 1 shown in FIG. 4 has a section resembling that of the beam of FIG. 3. This section is rectangular and the girder has an intermediate internal wall 41 which give rise, in the upper part of the girder, to a closed conduit 42, and, in the lower part, to a conduit 43 which, in this embodiment, is open towards the bottom. It also has two lower lateral wings 33, 34 and two intermediate lateral wings 35, 36. It is provided, at intervals, with legs such as 45 which support it at a certain height above ground level. The upper face 48 of the girder and the upper faces of the wings 33, 34, 35, 36 form plane reference surfaces for supporting various parts of the machine.

Webs such as 51, 52 support perfectly-aligned bearings 53, 54, 55 and 56 in which are journalled shafts 58, 59, 61 and 62, respectively.

The present-day mechanical construction techniques make it possible, in the piece formed by this central girder, to carry into effect with a high degree of precision parallelism and alignment of the bearing bores, as well as plane reference and support surfaces and distances apart.

The conduit 42 may serve, for example, for the circulation of a fluid suitable for bringing about a lowering of pressure necessary in certain part of the machine, while the lower conduit 43 may be used for the passage of electrical cables or for fluid ducts.

Figure 5:
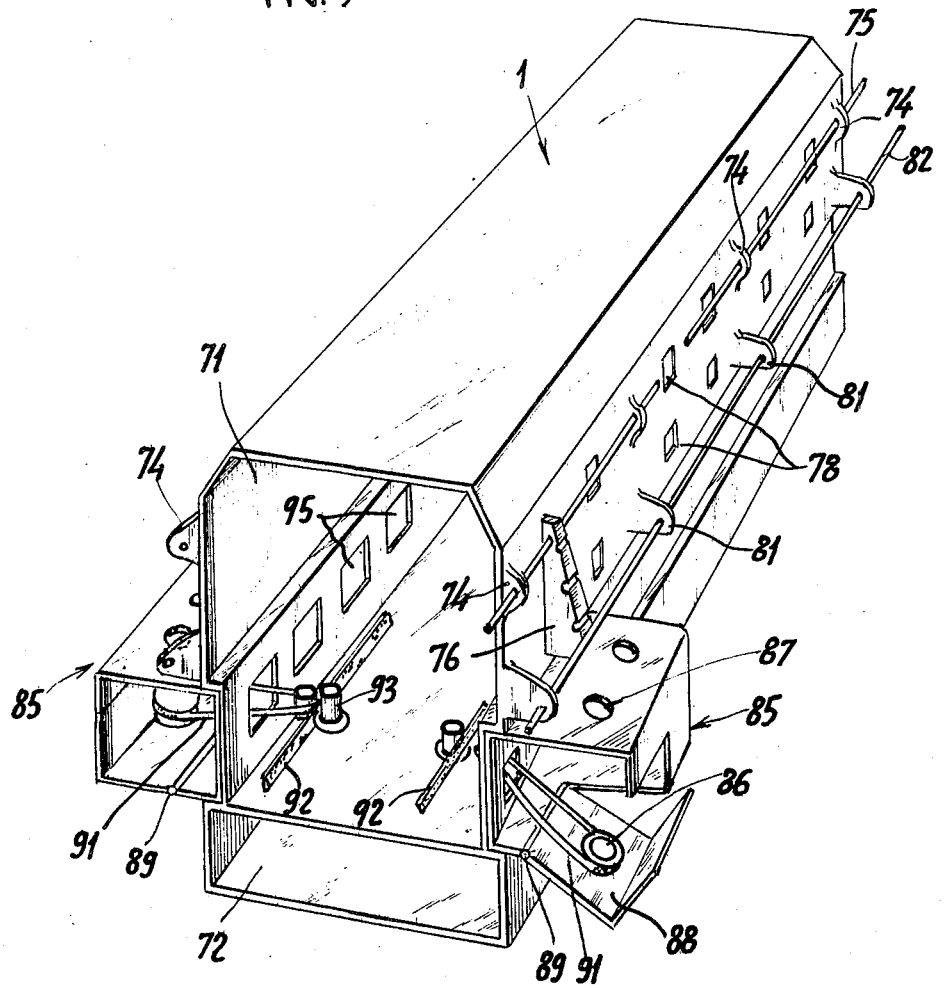
FIG. 5 is a perspective view of a modification of the frame of FIG. 4.

The modified girder shown in FIG. 5, again of basically rectangular section, has an upper longitudinal conduit 71 and a lowe longitudinal conduit 72. This girder is intended for forming part of the frame of a machine for spinning bast fibers. It includes, on its lateral faces, lugs forming aligned bearings 74 suitable for directing a rotary shaft, such as 75, which extends along the whole length of the girder. This shaft serves to carry along draft system blocks 76 which are strictly aligned and secured to lateral lugs 78 on the lateral face of the beam. Other lugs 81 form aligned bearings in which a stretching shaft 82 is journalled.

Open-end spinning devices generally referenced 85, and not represented in detail are mounted on the lateral faces of the girder. They mainly compries a rotor 86 and a fixed part 87. The rotor 86 is mounted in a part 88 of the device 85 which can swing or rock about a horizontal hinge 89. The drive for rotation of each rotor 86 is transmitted through an endless belt 91 from a primary belt 92 which passes over guide rollers inside the upper conduit 71 of the girder. The belts 91 pass through openings 95 cut in the lateral walls of the girder.

The mounting of the transmissions in the interior of the girder makes it possible to reduce noise and to facilitate maintenance and cleanliness of the machine.

Naturally the invention is not limited to the embodiments described and illustrated, and modifications may be made in accordance with the applications contemplated, without in so doing departing from the scope of the invention as defined in the following claims.

We claim:

1. A frame for a textile machine such as a spinning frame, a twisting machine or rewinding machine which includes a series of similar stations, said frame comprising a central longitudinally extending body solely defined by lateral, upper and lower walls providing a hollow girder of rectangular cross section, first wings constituting extensions of the lower wall extending normal to the lateral walls, second wings located between said first wings and the upper wall extending normal to the lateral walls in parallel relationship to the first wings, said first and second wings having plane upper surfaces for supporting machine parts, longitudinally spaced webs integral with the lateral walls and extending between the first wings and second wings providing reinforcing means for the lateral walls and support means for bearings, respectively, with the bearings being adapted to receive machine shafts extending axially of the girder, an internal wall constituting an extension of said second wings extending normal to the lateral walls providing a first conduit between the internal wall, the lateral walls and the upper wall and a second conduit between the internal wall, the lateral walls and the lower wall, and support legs for the girder.

2. The frame as claimed in claim 1 in which said girder is defined by a plurality of lengths, each having ends perpendicular to the general direction of the girder, with said lengths secured together end to end.

* * * * *